US009707433B1

(12) United States Patent
McGibbons

(10) Patent No.: US 9,707,433 B1
(45) Date of Patent: Jul. 18, 2017

(54) EXERCISE HANDLES AND BAND

(71) Applicant: Steven Paul McGibbons, So. Pasadena, CA (US)

(72) Inventor: Steven Paul McGibbons, So. Pasadena, CA (US)

( * ) Notice: Subject to any disclaimer, the term of this patent is extended or adjusted under 35 U.S.C. 154(b) by 0 days.

(21) Appl. No.: 14/525,099

(22) Filed: Oct. 27, 2014

(51) Int. Cl.
*A63B 21/02* (2006.01)
*A63B 21/00* (2006.01)

(52) U.S. Cl.
CPC ..... *A63B 21/1469* (2013.01); *A63B 21/028* (2013.01)

(58) Field of Classification Search
CPC .... A63B 7/00; A63B 7/02; A63B 7/04; A63B 7/045; A63B 21/0004; A63B 21/00043; A63B 21/00058; A63B 21/00061; A63B 21/00065; A63B 21/00069; A63B 21/00072; A63B 21/00076; A63B 21/00185; A63B 21/012; A63B 21/018; A63B 21/02; A63B 21/021; A63B 21/028; A63B 21/04; A63B 21/0407; A63B 21/0414; A63B 21/0421; A63B 21/0428; A63B 21/0435; A63B 21/0442; A63B 21/05; A63B 21/055; A63B 21/0552; A63B 21/0555; A63B 21/0557; A63B 21/0615; A63B 21/0616; A63B 21/0617; A63B 21/065; A63B 21/068; A63B 21/08; A63B 21/15; A63B 21/151; A63B 21/153; A63B 21/154; A63B 21/155; A63B 21/156; A63B 21/157; A63B 21/4019; A63B 21/4023; A63B 21/4025; A63B 21/4027; A63B 21/4033; A63B 21/4035; A63B 21/4039; A63B 21/4045; A63B 21/4047; A63B 21/4049; A63B 23/12; A63B 23/1209; A63B 23/1218; A63B 23/1227; A63B 23/1236; A63B 23/1245; A63B 23/1254; A63B 23/1263; A63B 23/1272; A63B 23/1281; A63B 23/14; A63B 29/00; A63B 29/02; A63B 29/024; A63B 29/028; A63B 29/08; A63B 2225/09
See application file for complete search history.

(56) References Cited

U.S. PATENT DOCUMENTS 2,164,995 A * 7/1939 Linman ..... D06F 53/00 24/136 K
2,743,497 A * 5/1956 Davis ..... A44B 11/10 24/196
3,112,816 A * 12/1963 Halford ..... B66D 3/10 188/65.2

(Continued)

FOREIGN PATENT DOCUMENTS

GB 2194256 A * 3/1988 ..... A62B 35/04

*Primary Examiner* — Loan H Thanh
*Assistant Examiner* — Gary D Urbiel Goldner

(57) ABSTRACT

A pair of exercise handles includes one handle that can fasten one end of an exercise band in a fixed position and another handle that can secure the other end at multiple locations, allowing a user to vary the resistance level for different exercises. The band may be marked with a sequence of numbers along its length to help the user establish particular resistance levels. The exercise handles include rigid connectors inserted through the interior of the handholds, which retain the handholds and allow them to freely rotate.

22 Claims, 18 Drawing Sheets

(56) References Cited

U.S. PATENT DOCUMENTS 3,506,262 A * 4/1970 Wade ..... A63B 21/018 482/120
3,591,900 A * 7/1971 Brown ..... A44B 11/10 24/196
3,717,339 A * 2/1973 Holkesvick ..... A63B 21/018 482/120
4,026,549 A * 5/1977 Gunn ..... A63B 21/0004 473/464
4,257,592 A * 3/1981 Jones ..... A63B 21/154 24/115 K
4,343,466 A * 8/1982 Evans ..... A63B 21/018 140/71 R
4,466,612 A * 8/1984 Marczewski .... A63B 21/00069 182/6
4,762,318 A 8/1988 Phillips
5,038,888 A * 8/1991 Varner ..... A62B 1/06 182/5
5,360,083 A * 11/1994 Hede ..... A62B 1/14 182/192
5,400,869 A * 3/1995 Rocourt ..... A62B 1/14 182/133
5,595,559 A * 1/1997 Viel ..... A61H 1/0237 482/114
5,800,322 A 9/1998 Block
5,803,209 A * 9/1998 Suzaki ..... A63B 21/018 182/191
5,807,214 A 9/1998 Riazi
5,850,893 A * 12/1998 Hede ..... A62B 1/14 182/193
5,853,356 A 12/1998 David
6,029,777 A * 2/2000 Rogelja ..... A62B 1/14 182/192
6,367,582 B1 * 4/2002 Derby ..... A62B 35/0037 119/857
6,398,698 B1 6/2002 Hinds
6,672,997 B1 1/2004 Winkler
6,692,415 B1 2/2004 Winston
6,732,833 B2 * 5/2004 Rogelja ..... A63B 29/02 182/193
6,860,841 B1 * 3/2005 Mortorano ..... A63B 21/0004 482/126
6,923,750 B1 8/2005 Hinds
7,278,960 B1 * 10/2007 McGibbons ..... A63B 21/0004 482/140
7,431,680 B1 * 10/2008 Hinds ..... A63B 21/0552 482/44
7,465,258 B1 * 12/2008 Mortorano ..... A63B 21/0004 482/126
7,625,324 B1 12/2009 Hinds
7,963,366 B2 * 6/2011 Christianson ..... A62B 1/14 182/5
8,316,989 B2 * 11/2012 Bamberg ..... A62B 1/14 182/193
8,403,818 B1 * 3/2013 Wilkinson ..... A63B 21/00069 482/121
8,782,854 B1 * 7/2014 Samuels ..... B25G 1/102 16/428
8,807,403 B2 * 8/2014 Nielsen ..... A45F 3/14 224/157
8,904,603 B1 * 12/2014 Samuels ..... A63B 21/0557 16/428
8,925,680 B2 * 1/2015 Herrli ..... A62B 1/14 182/192
9,333,385 B2 * 5/2016 Hinds ..... A63B 21/02
2002/0160891 A1 * 10/2002 Gallagher ..... A63B 21/04 482/123
2012/0245004 A1 * 9/2012 Bremer ..... A63B 21/00185 482/129
2013/0029813 A1 * 1/2013 Hetrick ..... A44B 11/2557 482/139
2014/0024508 A1 * 1/2014 Hinds ..... A63B 21/02 482/129
2014/0082891 A1 * 3/2014 Hetrick ..... A44B 11/2557 24/115 H
2014/0228183 A1 * 8/2014 Falconi ..... A63B 21/0557 482/122
2014/0274604 A1 * 9/2014 Ercanbrack ..... A63B 21/4033 482/129
2016/0023051 A1 * 1/2016 Lauener ..... A61H 1/0229 482/143
2016/0067543 A1 * 3/2016 Marvan ..... A63B 21/0557 482/121

* cited by examiner

EXERCISE HANDLES AND BAND

FIELD OF THE INVENTION

Exercise equipment.

BACKGROUND OF THE INVENTION

Resistance exercise devices comprising an elastic band secured between two handles are well known. In practice, these devices involve stretching the band between the handles such that tension created in the band exercises the muscles of the user. To allow for the level of resistance to be adjusted, it is preferable for the user to be able to shorten or lengthen the band relative to the handles.

A challenge inherent with equipment of this type is the inadvertent separation of the band from the handles, which can cause the band to snap back toward the user, possibly causing injury. To overcome this, prior art examples typically employ mechanisms to secure the band, such as clamps, buckles, impingers and the like. In order to adjust the length of the band, these mechanisms must be loosened and re-tightened which can be time-consuming. In general, bands have proven difficult to attach to handles in a cost-effective and user-friendly manner. As examples, Riazi (U.S. Pat. No. 5,807,214) discloses cinchable loops that constrict upon a band, David (U.S. Pat. No. 5,853,356) discloses a removable clip that locks a band in place, and Hinds (U.S. Pat. No. 6,923,750) discloses an impinger that secures a band in a cork-like fashion. These inventions involve moving parts which must be manipulated by the user and which require additional manufacturing and assembly steps.

Another challenge of exercise devices that employ exercise bands is that users typically have little way of knowing what resistance level they are exercising with. Unless a band has markings corresponding to different resistance levels, it can be difficult to adjust the length the proper amount. This represents a challenge for exercisers because strength training protocols typically call for the resistance level to be progressively increased from one workout to the next.

Yet another limitation is that the handholds of exercise handles are commonly fixed in relation to the handle, which can lead to wrist strain and also restricts the number of exercises that may be performed. Some handles do feature rotatable handholds, which is often accomplished by providing an inflexible strap or cord that passes through the handhold and secures to the base of the handle (see U.S. Pat. Nos. 4,762,318; 5,800,322; 5,807,214; 6,923,750). Having an inflexible strap requires additional steps to manufacture and assemble. Other prior art handles, such as Pagano, U.S. Pat. No. 1,749,544, feature handholds mounted on solid rods that are continuous with the arms of the handle. Such designs typically require the handhold to be made in two halves then connected once mounted on the rod or longitudinally split then reattached. More recently, Hinds U.S. Pat. No. 7,625,324 has disclosed a handhold with a rigid core that engages the arms of a handle. This design requires a significant amount of raw material to construct the core as well as prominent holes to be present in the arms.

The aforementioned inventions all have considerable merit, and their mention is not intended to denigrate them in any way. They are only mentioned to highlight certain challenges which are addressed by the current invention, and also because it is the expected convention to address the limitations of the prior art in a patent application. It is sincerely hoped that the present invention will help exercisers to achieve results in a more effective and efficient manner, thereby triggering a cascade of fitness and joy to spring forth in the world.

OBJECTS AND SUMMARY OF THE INVENTION

Accordingly, it is an object of the present invention to provide an exercise handle that can safely and reliably secure an exercise band, without the use of an external fastening mechanism, thus allowing for length adjustments to be made quickly and easily.

Another objective is to provide exercise handles with rotatable handholds.

An additional objective is to provide an exercise handle with a simple design that can be manufactured easily and inexpensively.

Another objective is to provide an exercise band with different resistance levels indicated along the length of the band.

A further objective is to provide an exercise kit, consisting of two handles and one or more exercise bands.

The aforesaid objects are achieved individually and in combination, and it is not intended that the present invention be construed as requiring two or more of the objects to be combined unless expressly required by the claims attached hereto.

The present invention includes a pair of exercise handles, each having two arms with members disposed between them. An exercise band is threaded around the members in such a way that the band makes a number of turns and doubles back upon itself. The turning in the band combined with friction is sufficient to hold the band in place so that it doesn't slip during exercise. To adjust the effectual length of the band, one may simply pull the band at the proper angle, which causes the band to slide in relation to the handle. In the preferred embodiment, length adjustments are made at one handle, while the other handle fastens the band in a fixed manner.

In this application, the term "engage" and all of its derivatives refer to a situation in which different objects are brought in contact with one another. The term "secure" and its derivations refer to an engagement in which the position of the band relative to the handle is temporarily fixed but can be readily adjusted. The term "fasten" and its derivatives refer to a more steadfast engagement in which the position of the band is indefinitely fixed, until disengaged by the user. For example, one end of an exercise band may be fastened to an exercise handle so that it is held in place for the entirety of a workout, while the other end of the band may be secured to a second handle so that the length of the band may be continually adjusted. It is to be understood that length adjustments discussed herein refer to a band's effectual length not the absolute length which, of course, remains fixed.

In this application, the term "base structure" is a general term referring to the part of an exercise handle that engages an exercise band. It should be noted that the base structure includes all of the elements that are necessary to secure an exercise band. In viewing the prior art, several of the handles employ clips, clamps, impingers, or other such securing mechanisms. In these examples, the securing mechanisms would be considered to be part of the base structure. For the present invention, the base structure has two members that are positioned between the arms of the exercise handle, with an opening between the members. The terms "member" and "opening" are general terms that are not restricted to any specific structure or configuration. Rather, they serve functional roles. Specifically, the members of this invention allow for a band to adopt a desired configuration, and the opening allows for a band to be passed through in either direction.

When a band is secured to the base structure in the manner specified herein, the band will change direction, or turn, multiple times. This turning helps the band to hold its position relative to the base structure. In general, the more turning that is present in the band, the more secure the connection and the less likely the band will be to slip during use. However, excessive turning can make it difficult to adjust the length of the band. In this application, the turning present in the band is signified by the phrase "amount of turning" and refers specifically to the amount of turning around the base structure. In addition to the amount of turning in the band, friction between the band and the base structure and between opposing sections of the band that are in contact with each other further prevent the band from slipping. It has been found that the friction generated is especially significant with bands made of rubber, which facilitates securement.

Together, the configuration of the base structure plus turning within the band are all that are required to secure the band to the handle. No clamping, pinching, or other such mechanisms are required. To adjust the effectual length of the band, the user can simply manually pull the band in either direction through the opening. In this manner, the band may be adjusted faster and easier than prior art examples.

Furthermore, the band may be adjusted without the user ever having to physically touch the band. When the band is in a slightly stretched state, the user may rotate the handle to reduce the amount of turning in the band, thereby decreasing the degree of securement. Once the handle is rotated sufficiently, the band will become unsecured, at which point tension in the band will naturally pull it through the opening. This allows the user to increase the length of the band without removing either hand from the handholds. It also makes it possible to decrease the resistance level in the middle of an exercise set—an action which takes a fraction of a second—and continue doing additional repetitions. This is a significant benefit because it allows the user to more thoroughly exercise their muscles during a set, which can lead to faster muscle growth. This is one reason why weightlifters often have a workout partner, or spotter, provide assistance towards the end of an exercise set when they are too tired to do additional repetitions at the selected level of resistance. The spotter bears some of the burden, thereby reducing the effective resistance level, allowing the exerciser to do additional repetitions to achieve a greater degree of muscle exhaustion.

When a person exercises alone, they typically have no way of easily reducing the resistance level during a set. Instead, they must stop exercising to do so. They can try to quickly resume exercising, but muscles will recover somewhat during the rest period, which will affect the quality of the set and, ultimately, the results one sees. In contrast, this invention allows resistance to be adjusted while the band is under tension so that there is no rest period during length adjustments. Furthermore, the length may be adjusted multiple times during a single set, allowing a user to more fully exhaust their muscles to help enhance muscle growth. This is especially significant considering the discovery in recent years of the important role that muscle mass plays in relation to metabolism and weight control. In addition, this invention allows a user to switch from one exercise to the next quickly and without having to regrip the handholds. The user can adjust the resistance level and immediately move onto the next exercise. This can be useful during circuit training workouts in which one of the goals is to keep the heart rate elevated.

The handles of this invention also come with wedges which serve to pin the band against the base structure, thus fastening the band in place and preventing inadvertent shifting of the band relative to the handle. For traditional strength training workouts, a wedge can be inserted into one handle but not the other. This allows the band to be fastened to one handle while being easily adjustable at the other. For cardiovascular workouts such as rowing in which a constant resistance may be desired, wedges can be inserted into both handles so that the effective length of the band remains fixed.

In the preferred embodiment, the exercise bands are extensible and may be manufactured from an elastic polymer, including natural rubber, synthetic rubbers, and blends thereof. To allow the user to exercise with particular levels of resistance, the bands may be marked with a series of numbers along their length. This also makes it possible to keep track of resistance levels used from one workout to the next. For versatility, bands may be removed from the handles and interchanged with other bands of varying thickness. The handles may also be configured to engage multiple bands simultaneously.

Another feature of the present invention is that the handholds rotate during use. Having rotatable handholds is generally perceived to be more comfortable and appealing than fixed handholds. It allows the user to exercise with significantly less straining in the hands and wrists, which maintain neutral positions at every point during an exercise movement as the handhold rotates. Rotatability is achieved by way of a long connector projecting medially from one of the exercise arms, which is inserted through the handhold and connected to the opposite arm. The connection is a strong and permanent one, able to withstand substantial torque forces that may occur when stronger individuals use the device. The structure of the handles and connector allow them to be molded in one piece and assembled quickly and easily.

DETAILED DESCRIPTION OF THE EMBODIMENTS

Figure 1:
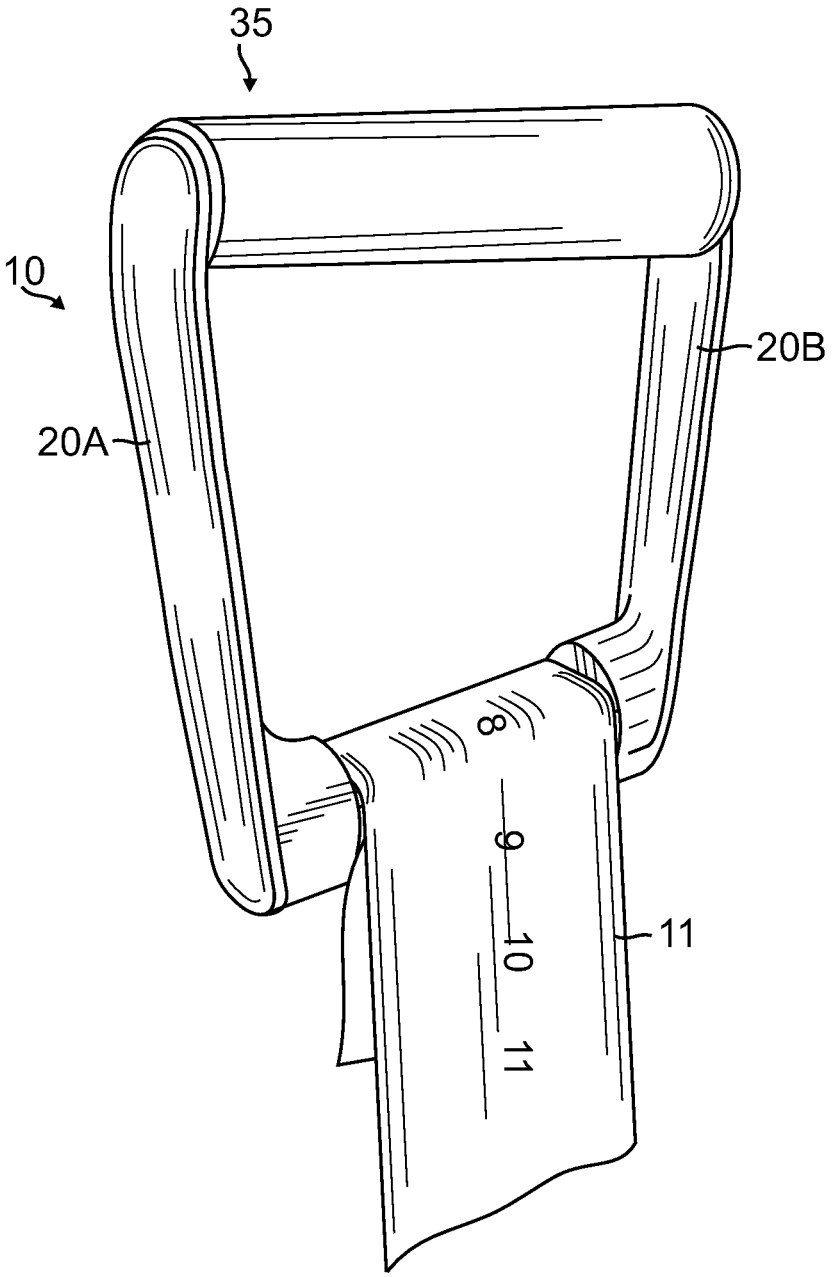
FIG. 1 is a perspective view of the front side of an exercise handle with an exercise band secured.
Figure 2:
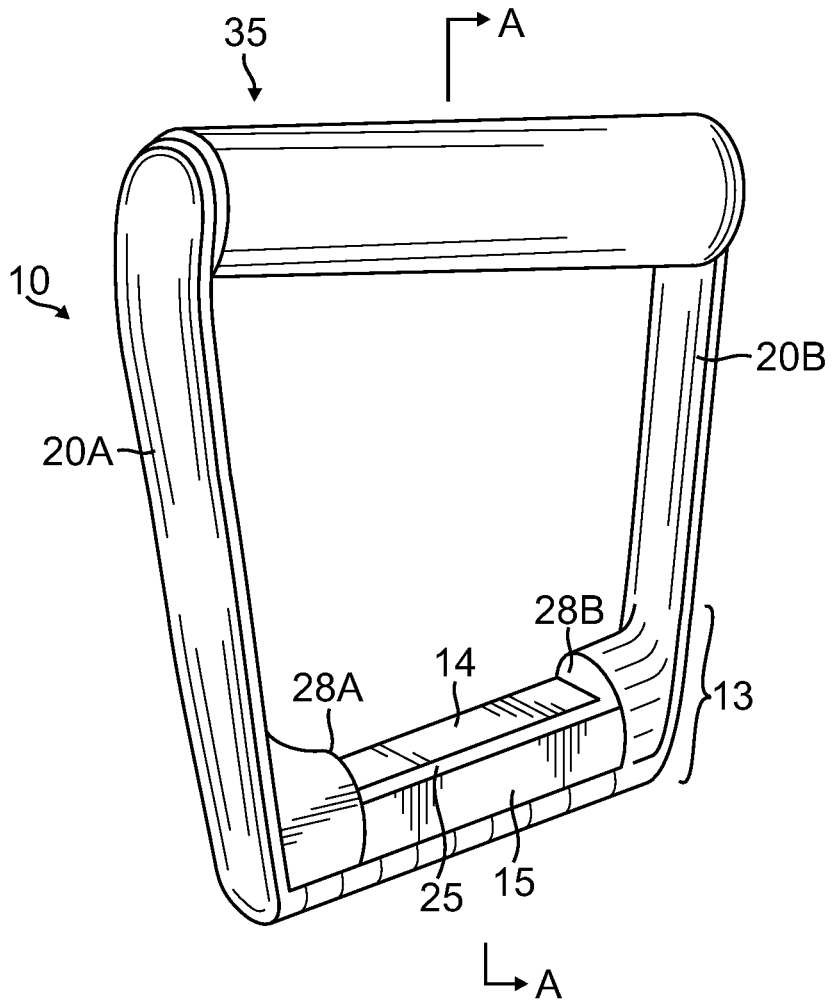
FIG. 2 shows the front side of the handle.
Figure 3:
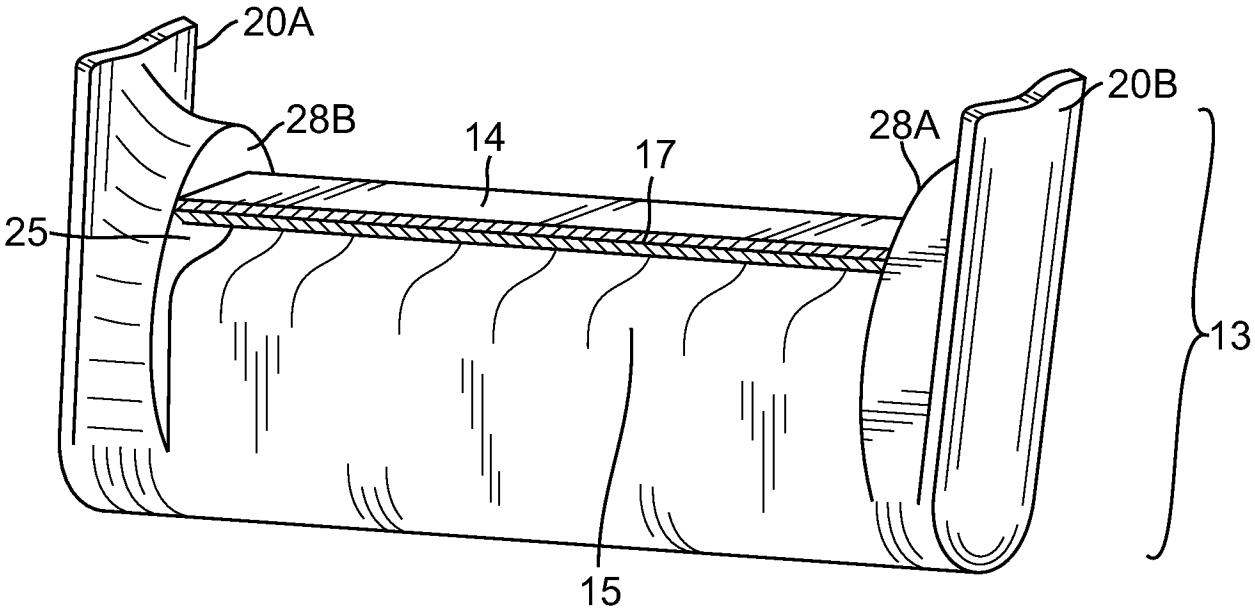
FIG. 3 shows the backside of base structure 13.
Figure 4:
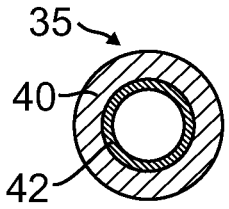
FIGS. 4-7 depict sagittal cross sectional views of the handle through A-A of FIG. 2.
Figure 4:
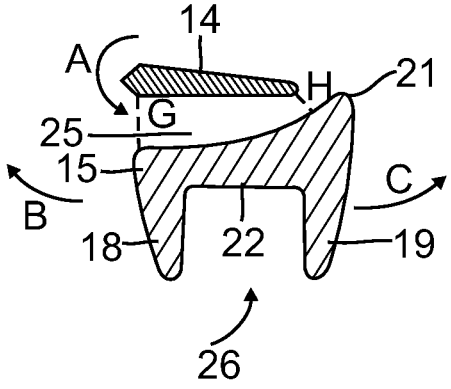

In FIG. 1, an exercise handle depicted generally by the numeral 10 is shown securing planar exercise band 11. As can be seen in FIGS. 2-3, the handle includes base structure 13, with arms 20A and 20B attached to and extending from the base structure and retaining handhold 35. Base structure 13 includes rigid members 14 and 15 which extend inward from arms 20A and 20B. FIG. 4 shows that member 15 includes walls 18 and 19 and guide 22. Members 14 and 15 are surrounded by atmosphere so that an opening, or slot 25, is formed, possessing both an entrance and exit through which exercise bands may be passed.

The members and slot extend lengthwise along base structure 13 in a direction that is generally parallel to handhold 35, such that a coronal cross-section through FIG. 1 would reveal that the members, slot, and band are parallel to the axis of handhold 35. This allows an exercise band to pass through the base structure in a flat, unwrinkled fashion. The slot has a side-to-side length that is generally equal to or slightly wider than the width of the bands being used, which helps prevent the band from shifting back and forth in the slot. With the preferred band width, this translates into members and a slot which extend across the majority of the distance between arms 20A and 20B. The members and slot are elongated, with the slot having a side-to-side length that is significantly greater than the height, wherein the height is represented by the distance between members 14 and 15. More specifically, the length is multiple times greater than the height, especially where the height is the smallest, at H of FIG. 4. However, this is not required for the handle to function effectively.

To secure band 11 to handle 10, end 12A is passed over member 14 then inserted through slot 25 as indicated by arrow A of FIG. 4. End 12A is first inserted through the entrance G, then steered upward by guide 22, before passing through exit H. The user then pulls end 12A a desired amount to establish the level of resistance. To ensure that the user inserts the band through slot 25 in the proper direction, an arrow may be imprinted on the handle.

Figure 5:
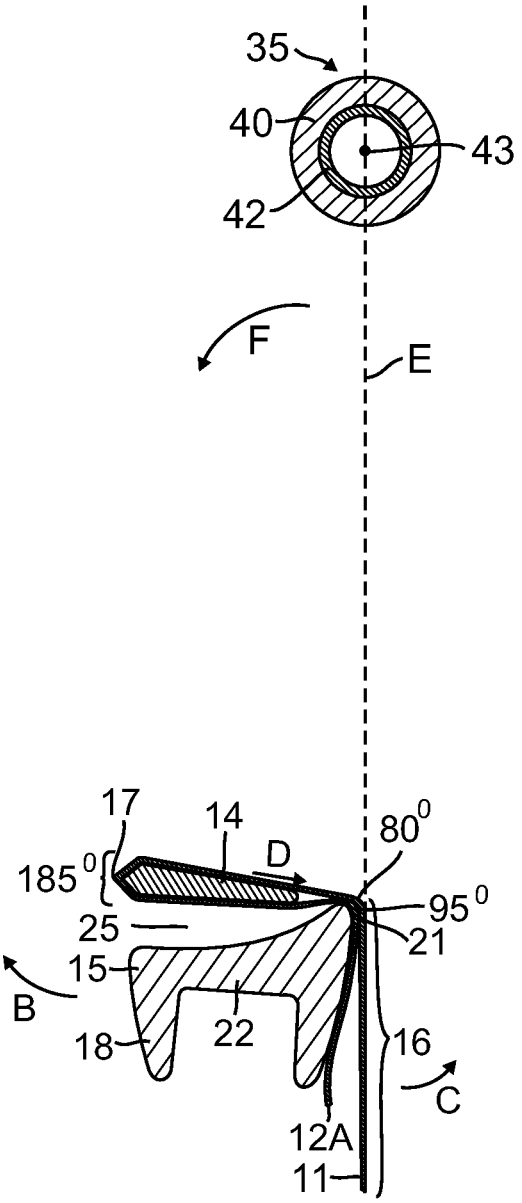

When the band is thus secured, it will be partially wrapped around members 14 and 15, being wrapped around one member in a clockwise manner and the other in a counterclockwise manner, such that the band changes direction, or turns, multiple times. As shown in FIG. 5, these turns occur at edge 17 and curve 21. Collectively, the total amount of turning in the band helps secure it to the base structure during exercise. The greater the amount of turning, the more secure the band. However, as the amount of turning increases, this also makes it more difficult to adjust the length of the band. Ideally, base structure 13 will be configured so that band 11 won't slip during exercise while still allowing for easy adjustment.

For illustration purposes, consider the degrees of turning present in each turn in FIG. 5. Starting from the section of band that is under the greatest amount of tension during exercise, signified by section 16, and working towards end 12A, the first turn around curve 21 is approximately 80 degrees, the second turn around the posterior end of member 14 is approximately 185 degrees, and the third turn around curve 21 is approximately 95 degrees so that the total amount of turning is roughly 360 degrees.

It should be noted that the amount of turning is not determined when handle 10 is in the vertical position of FIG. 4, but rather the "equilibrium" position of FIG. 5. Whenever band 11 comes under tension during exercise, the handle will naturally rotate in the direction of arrow B until section 16 becomes aligned with the central axis of handhold 35, signified by point 43. This position is, in most cases, maintained throughout the duration of an exercise set, as long as the band is under tension.

In addition to the total amount of turning in band 11, friction is another element that helps hold the band in place. Band 11 comes into contact with itself around curve 21, where band-to-band friction is created. During use when the band is under tension, section 16 presses the opposing section of band firmly against curve 21, helping anchor the band in place and preventing it from slipping in the direction of arrow D. Moreover, as section 16 stretches downward, friction causes it to pull part of the opposing section downward along with it, which further helps hold the band in place. It has been found that bands made of rubber can generate substantially greater band-to-band friction than other materials like cloth or leather. The band could also be specially manufactured with a coating that makes the surface stickier to generate even more friction.

To further enhance the securement of the band, base structure 13 may contain bumps, grooves, striations, serrations, or other surface features designed to generate additional friction to help anchor the band in place. These features may be especially effective at edge 17 or curve 21, though in the preferred embodiment, the edge and curve are smooth. Of note, edge 17 is a sharp edge extending laterally across the posterior surface of member 14 which causes band 11 to change direction abruptly as it wraps around member 14. This leads to a greater degree of securement than if member 14 were rounded at edge 17, as it has been found that a sharp turn is more effective than a gradual turn. Overall, the amount of turning in the band, combined with the configuration of the base structure is sufficient to secure the band during use. "Configuration of the base structure" in this context refers to any structural features that can enhance securement—member configuration, sharp edges, serrations, or various other surface features.

One thing that distinguishes handle 10 is that a band may be secured without the use of clamps, latches, clips, hooks, impingers, cinchable loops, or other such securing mechanisms. No part of the handle needs to be manipulated or moved for a secure connection to be established. In general, the configuration of the base structure need not be altered in any way by the user for the band to be either secured or adjusted. In other words, no part of handle 10 needs to be shifted or moved relative to the rest of the handle in order to secure a band. Furthermore, no objects which exist separately from handle 10 are required to secure a band. For instance, a handle design could call for a rod or other similar object to be introduced to the base structure, in order to help secure a band. Although no moving parts are required to secure or adjust band 11, it should be noted that some parts may bend while the band is under tension. For example, it is possible that the members may be pinched together slightly when the band comes under tension. This could serve to squeeze the section of the band that is disposed between these members, which would increase the security of the connection. In this situation, the members would not be considered to be moving parts.

Another noteworthy feature of handle 10 is that arms 20A and 20B along with base structure 13, including members 14 and 15, exist as one solitary piece. This simplifies the manufacturing process as the entirety of the handle, except for handhold 35, may be injection molded together at the same time in a single piece using the same raw material.

Pertaining handhold 35, it is made up of hollow, rigid tube 42 surrounded by pliable grip 40, a cross section of which is shown in FIG. 4. The handhold is generally cylindrical and is adapted to comfortably fit the palm and fingers of a user. Grip 40 may have a contoured surface for a more comfortable fit. In the preferred embodiment, handhold 35 is engaged with arms 20A and 20B in a non-fixed manner such that the handhold is allowed to freely rotate with respect to the rest of the handle. During various exercises, parts of the hand may enter into the space between handhold 35 and member 14 as the handhold rotates. Accordingly, it is preferable that this space be sufficiently wide to accommodate this.

Figure 6:
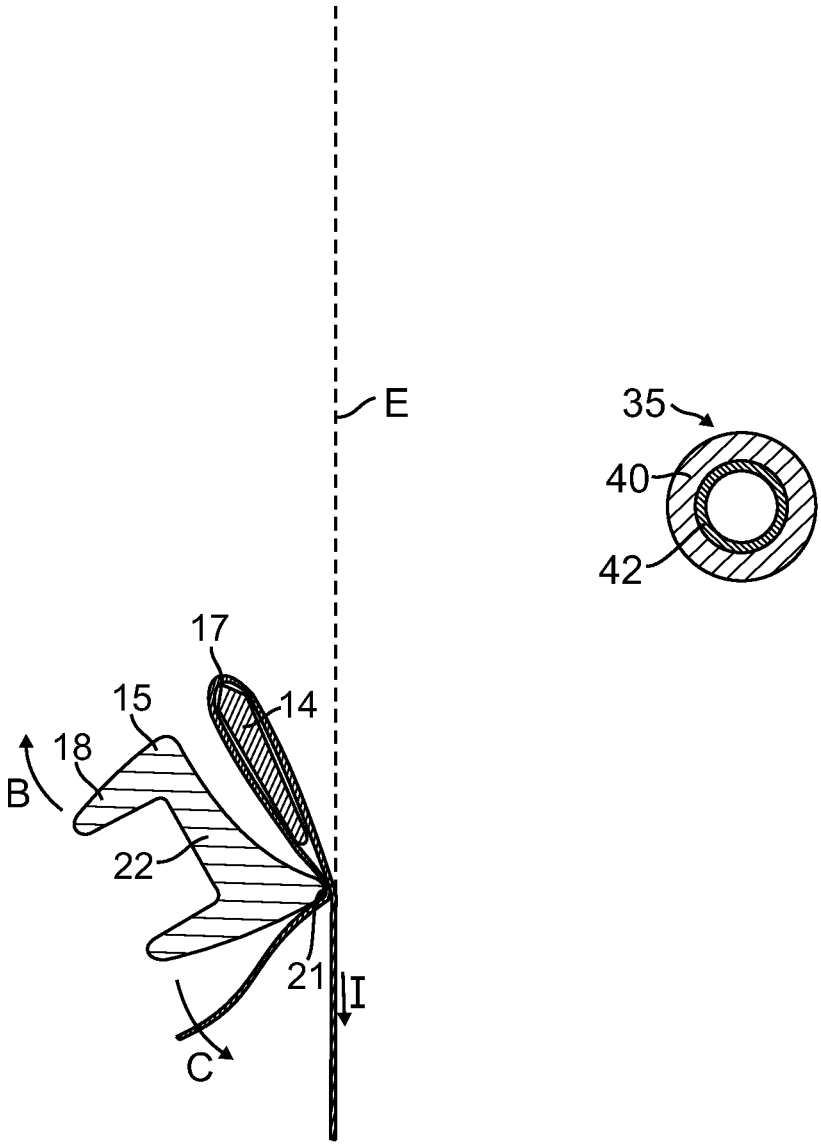

The exercise device of the present invention exists in two basic states, locked, in which the band will not slip relative to the handle, and unlocked, in which the band length may be adjusted. The state depends upon the orientation of the handle relative to the section of the band which is under tension during exercise. The locked state occurs during exercise when section 16 of band 11 becomes generally oriented towards the central axis of handhold 35, as shown in FIG. 5. The unlocked state is achieved when the orientation of section 16, signified by dotted line E, is shifted in the direction of arrow F by a sufficient amount relative to handle 10. As section 16 is shifted, both the amount of turning and band-to-band friction will steadily decrease until a point is reached where the handle becomes unlocked and the band may be adjusted. This is shown in FIG. 6. It should be emphasized that shifting the orientation of handle 10 relative to section 16 is all that is required to switch the exercise device back and forth between the locked and unlocked states.

There are two basic ways to shift the orientation of section 16. One is to rotate handle 10 in the direction of arrow B until it adopts the configuration of FIG. 6. The user may then pull on end 12A to shorten the length of the band or on section 16 to increase it. Once the band has passed through slot 25 the desired amount, the user then releases the handle, which will naturally rotate back in the direction of arrow C, thus returning the handle to the locked state. A second way of shifting the orientation of section 16 is for the user to simply lift section 16 upwards in the direction of arrow C. In this situation, section 16 will adopt the same effective orientation, or angle, relative to handle 10 as shown in FIG. 6, except that the handle will hang down vertically. The user can then pull on section 16 in the direction of arrow I to increase the effectual length of the band. Alternatively, the user can lift end 12A upwards in the direction of arrow C, and then pull the band in order to decrease the effectual length.

A useful feature of the present invention is that a user may adjust the band during an exercise set while the band is under tension. While still holding handhold 35, the user can press a finger or part of a palm against arm 20A or 20B to rotate handle 10 in the direction of arrow B. To facilitate the rotation of the handle, arms 20A and 20B may contain protuberances or tabs that can be pressed against digitally. As soon as the handle has rotated sufficiently, the band will start to slip, as tension in the band naturally pulls it through slot 25. Once the desired resistance level is achieved, the user then releases the arm, which will cause the handle to rotate back in the direction of arrow C, returning the handle to the locked state. In this manner, the user may decrease the resistance level without having to take either hand off of the handholds.

Another feature of the exercise device is that band 11 may be detached from handle 10 and exchanged for different exercise bands of varying thicknesses, allowing the user to exercise with a broad range of resistance levels. Furthermore, slot 25 can be configured to be wide enough to accommodate two or more exercise bands simultaneously. The user can lay the bands on top of each other and then thread the ends simultaneously through slot 25 in the usual fashion. Having a slot that is wide enough to accommodate multiple bands has the further advantage of allowing both ends of a single band to be passed through the slot and secured to the handle, thus creating a loop. The loop may be wrapped around various objects to allow for a greater range of exercises to be performed. For example, the loop may be wrapped around the foot for certain lower body exercises or around table legs, posts, or other stationary objects as an anchor point.

To allow for smooth and controllable length adjustment, handle 10 is designed to retain band 11 so that it remains flat and unwrinkled, without shifting sideways appreciably. For one, slot 25 is fairly narrow which helps prevent wrinkling as the band slides through the base structure. In addition, guides 28A and 28B of FIG. 2 help keep band 11 in place.

When band 11 is under tension, it will hug member 14 tightly, as shown in FIG. 5. When the band relaxes, as might occur between exercise repetitions or exercise sets, gaps can form between the band and member 14, as depicted in FIG. 6. When the band is pulled tight again, it will regrip member 14. During the regripping process, it is possible that the band may shift slightly in relation to the base structure. The amount of shifting, if any, depends upon a number of factors, including the design of the base structure, the composition of the band, and the nature in which the user relaxes. In the event that the band does shift, this may alter the effectual length which, of course, will change the level of resistance. There are some situations where this can be advantageous, as will be discussed shortly.

Figure 7:
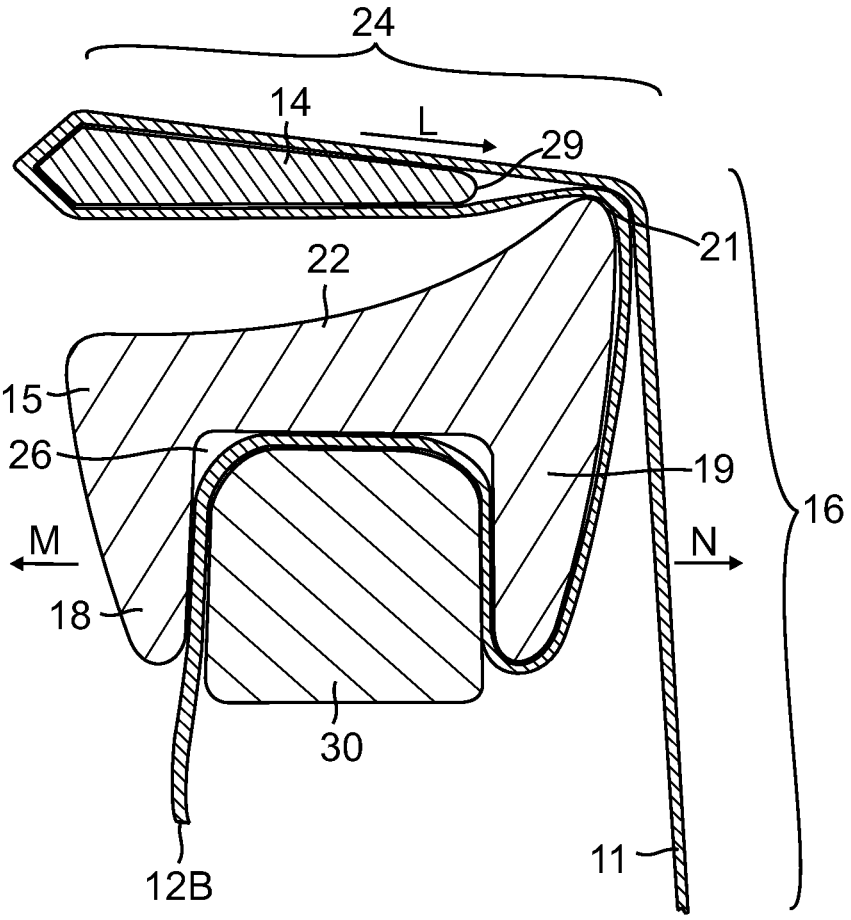
Figure 9:
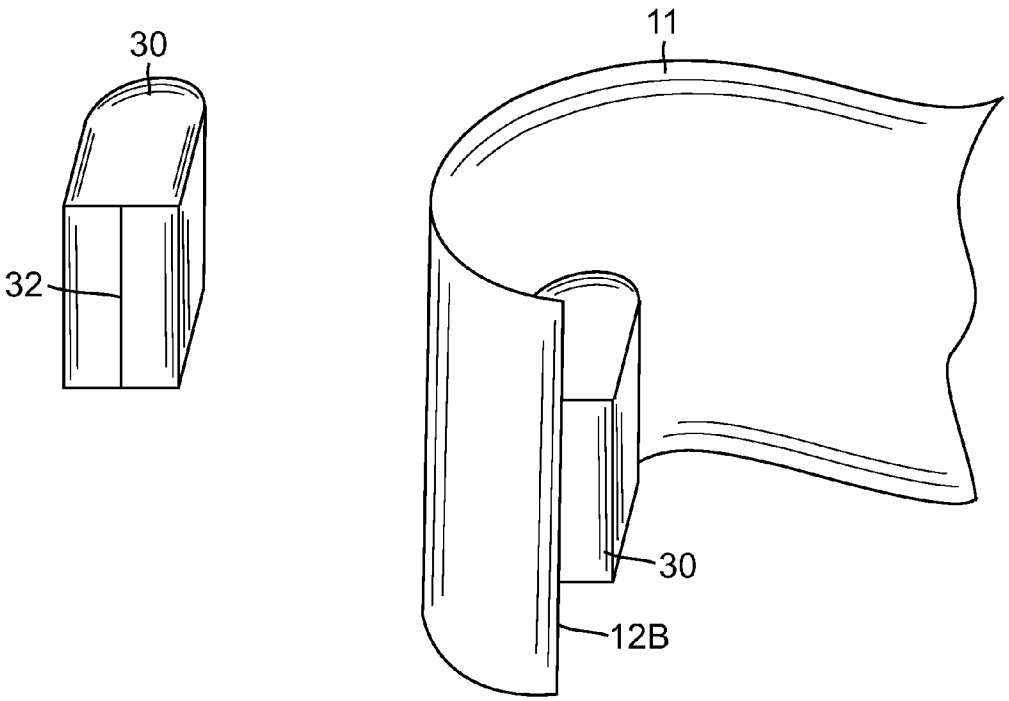
FIG. 9 shows the end of a band lined up with respect to demarcation 32 on wedge 30.

However, there are also situations where the user may wish to prevent the band from shifting. One simple way to accomplish this is for the user to maintain a small amount of tension in the band in between repetitions, rather than relaxing completely. Another option is for the band to be anchored to the base structure as shown in FIG. 7. Wedge 30 is inserted into cavity 26, which significantly increases the amount of turning in band 11. In addition, the band is pressed firmly against walls 18 and 19, helping to hold the band in place. Walls 18 and 19 are designed to be flexible so that they bow outward in the directions of arrows M and N as wedge 30 is inserted into cavity 26. This permits bands of various thicknesses to be fastened to handle 10, as well as multiple bands simultaneously. In addition, band 11 and wedge 30 have some degree of compressibility, which further allows the fastening of various bands. As shown in FIG. 9, wedge 30 is not as wide as band 11 and, consequently, base structure 13. This allows wedge 30 to be inserted into the medial portion of cavity 26, where walls 18 and 19 are the most flexible.

In some instances, the user may wish to exercise with the band fastened to two exercise handles. In other words, the user could fasten both ends of a band to two exercise handles, using two wedges. This would allow the user to exercise with a constant level of resistance for as long as they desire. In other instances, the user will want to adjust the length of the band frequently. To accommodate this, it is preferable to have one end of the band fastened to one handle in the manner shown in FIG. 7, and the other end of the band secured to a second handle in the manner shown in FIG. 5.

Figure 8:
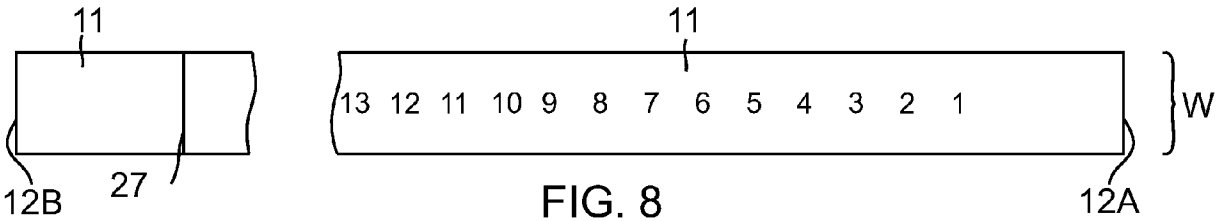
FIG. 8 shows an exercise band.

Turning now to the exercise band, as shown in FIG. 8, the band may be imprinted with a sequence of markings to allow the user to establish resistance levels in a controlled fashion. This would also allow the user to keep track of particular resistance levels used during workouts, which is useful during training routines. In the preferred embodiment, the band has a sequence of numbers beginning toward one end of the band and increasing in value approaching the other end of the band. FIG. 1 shows a band secured to the base structure of handle 10 and illustrates how the resistance level may be determined. In practice, the number that is visible on top of member 14—number "8" in the case of FIG. 1—signifies the resistance level. To assist the user in lining up the band precisely, the base structure could have an arrow designed to point medially to the desired number.

To allow the numbers imprinted on band 11 to correspond to consistent levels of resistance, it is desirable to have the band fastened to one handle and secured to the other. By being fastened to one handle, this allows the section of band that is under tension to begin at a predetermined starting point, a point which remains essentially fixed from one repetition to the next. One way to achieve this is for the user to line up demarcation 27 next to a particular location on the base structure. In looking at FIG. 1, demarcation 27 could be in the same position with respect to the handle as the numeral "8." Another option is depicted in FIG. 9. The user first aligns end 12B with line 32 of wedge 30, then inserts the wedge and band into the cavity of the base structure. This is a simple and easy way to ensure that the band will be lined up with respect to the handle in a consistent manner. Note that with this option, the starting point would be located at the position of the band adjacent to curve 21.

The other end of the band may be secured to a second handle, allowing the band length to be continually adjusted. The numbers on the band will allow a user to exercise with consistent levels of resistance from one workout to the next and to track resistance levels used over the course of a strength training program. To carry out the present invention, an exercise kit may be provided comprising two exercise handles and extensible exercise bands of various thicknesses. It should be noted that the band of FIG. 8 does not need to be used with the exercise handles described herein. It could also be used with other forms of exercise equipment, or merely gripped manually by a user such that the starting point is positioned at a particular position relative to one of the user's hands.

Members 14 and 15 have several features not yet discussed. Turning to FIG. 7, due to the friction generated around curve 21, there is a substantial reduction in tension in section 24 of band 11 as compared to section 16. As a result, member 15 bears the bulk of the load during exercise, which is why it is designed to be thicker and stronger. Member 14 bears a much smaller load, which allows it to be significantly smaller. Member 14 is relatively flat and thin with a width that is substantially greater than its height. Because member 14 is fairly wide, rather than being a small circular rod for instance, this provides more surface area for friction to be generated between band 11 and member 14, thus helping facilitate securement. This also helps impart stability to member 14. When section 24, which undergoes some degree of tension during exercise, is pulled in the direction of arrow L, the fairly large width of member 14 will help prevent it from bending. If member 14 were a thin rod, it could bow towards curve 21, which could lead to warping with repeated use. Of note, the upper surface of member 14 tapers downward, so that anterior edge 29 is relatively thin. This further imparts stability to member 14. If member 14 did not taper and were instead rectangular so that anterior edge 29 were thicker, then the section of band 11 disposed between anterior edge 29 and curve 21 would exert a slight but significant downward force on member 14. Over time, this could cause member 14 to warp in the direction of guide 22.

Another benefit of member 14 being thin is that this helps facilitate length adjustment. Because bands have a certain degree of rigidity, band 11 will loop around the posterior edge of member 14 when the band becomes untensioned. As shown in FIG. 6, gaps are present between the band and member 14, thus reducing the amount of friction and allowing the band to slide smoothly during length adjustment. Furthermore, because member 14 is beveled with sharp edge 17, this facilitates the creation of gaps. If the posterior edge of member 14 were instead rounded, the band might hug member 14 and get hung up as the user tried to adjust the band.

Regarding the spacing between members 14 and 15, slot 25 is sufficiently wide to allow band 11 to easily pass through. Slot 25 could be narrower than what is shown in the drawing figures, as long as members 14 and 15 do not compress the band in a manner which impedes passage of the band.

As shown in FIG. 4, guide 22 is curved upward, which increases the amount of turning present when band 11 is secured. More specifically, the uppermost point of curve 21 relative to the underside of member 14 is such that band 11 must angle downward as it passes between curve 21 and edge 29, which is best seen in FIG. 7. Member 14 is narrower than member 15, providing additional room for guide 22 to curve upwards to a greater degree. Of course, guide 22 could curve upwards even more to further increase the turning in the band. As member 15 curves upward, slot 25 progressively narrows or tapers. The slot is wider at entrance G, which makes it easier to insert the end of band 11 during securement, and narrower at exit H, which helps keep band 11 in place to help prevent it from slipping in between repetitions.

There are certain situations in which it may be desirable for band 11 to slip during an exercise set. To accomplish this, the user may purposefully relax following a repetition, doing so in an abrupt and exaggerated manner so that significant slack develops in the band. When the band regrips the base structure during the subsequent repetition, it may assume a new position with respect to the base structure by shifting in the direction of arrow I, so that the effectual length of the band is slightly longer than before. In this manner, a user can exercise so that the level of resistance is gradually reduced as a set progresses. This can help strengthen muscles by more thoroughly exercising them, as discussed previously.

In the preferred embodiment, handle 10 is designed to restrict the band from slipping (unless desired by the user), so that any slipping which occurs is negligible. However, the handle could be designed so that slipping is more significant. For example, members 14 and 15 could be reconfigured so that the amount of turning in the band is reduced and curve 21 could be narrowed or even converted into a sharp edge so that there is less band-to-band friction. These changes would lead to a less secure connection, making the band more likely to shift.

Figure 10A:
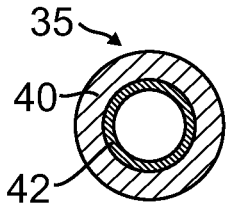
FIGS. 10A-D are cross sectional views of different base structure embodiments.
Figure 10A:
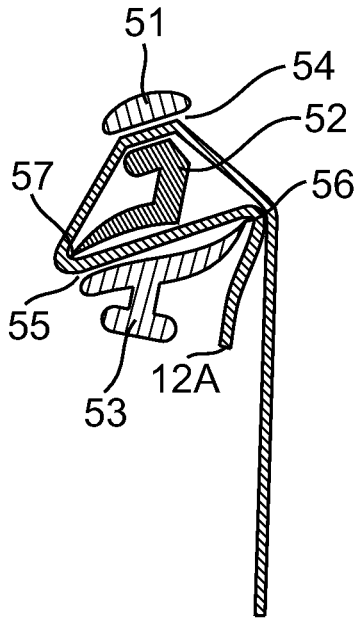

Turning now to alternate embodiments, it should be noted that certain deviations from the configurations and orientations of the base structure depicted thus far are possible without affecting the basic functionality of the handle. For example, FIG. 10A shows a handle with 3 members, 51, 52, and 53, and two slots 54 and 55. To secure band 11, end 12A is first threaded through slot 54 then back through slot 55. Sharp edge 56 results in less band-to-band friction than a curved surface. Sharp edge 57 is lower than edge 56, which causes the band to follow a downward trajectory through slot 55, which increases the total amount of turning in the band. Member 51 functions as a guide which helps retain the band in place during exercise, especially when the band is in a untensioned state. Additionally, a guide could be positioned at various other locations to help retain band 11. For example, a guide in front of or on the underside of the base structure would be effective. Such a guide could consist of a rod, with the band being tucked between the rod and the base structure after the length of the band is adjusted the desired amount. In addition, the base structure could be equipped with a clamp or other fastening mechanism, though this would require unfastening during length adjustment.

Figure 11:
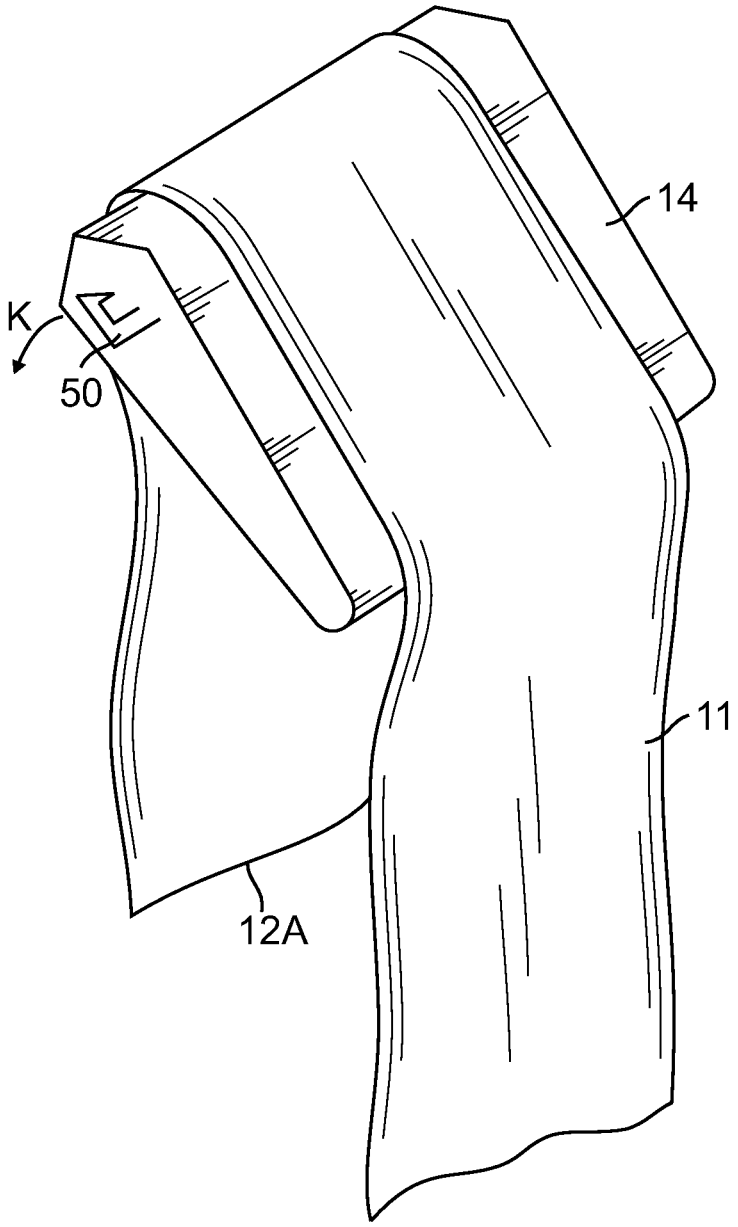
FIG. 11 shows a band partially wrapped around member 14.

Regarding the members, they need not be permanently attached to arms 20A and 20B. For example, member 14 could be removable and attached to the arms at the time that band 11 is engaged with the base structure. For example, a user could first wrap band 11 around member 14, to establish the configuration of FIG. 11. The member would then be inserted into the base structure, an action which would engage two fastening mechanisms at either end of member 14, fastening the member to the arms. For example, flexible latch 50 could engage with a protuberance on the corresponding arm of the handle. The latch would bend in the direction of arrow K and then snap in place over the protuberance. Note that the protuberance is not depicted in the drawing figures, but can be readily understood. To detach member 14, latch 50 would be bent in the direction of arrow K to free it from the protuberance. Another way to secure an exercise band would be to first lay it over the base structure after which member 14 would be snapped in place over the band. The band would then be brought back over member 14 to establish the customary position. Rather than being detachable, member 14 could be permanently attached at one end to one of the arms but free at the other end, allowing the member to pivot back and forth. The member would pivot into place and the free end fastened to the corresponding arm.

Figure 10B:
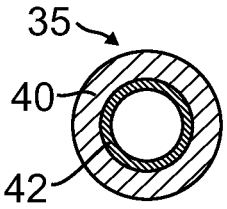
Figure 10B:
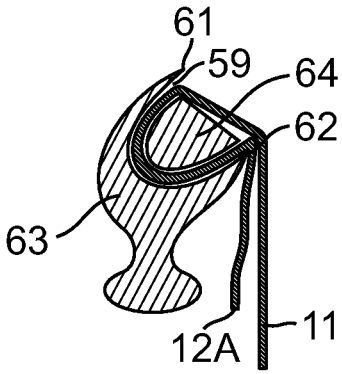

By having member 14 fastened in place separately, this allows it to be manufactured separately from the rest of the handle. This makes it easier to manufacture base structures with certain configurations, such as that shown in FIG. 10B. Member 63 is substantially C-shaped and permanently fixed to the arms whereas member 64 is generally rod-shaped and fastened separately. Note that while member 64 could be manufactured separately, it could also be made with the rest of the handle, and connected to one of the arms by a thin, flexible section that pivots back and forth with member 64.

Figure 10C:
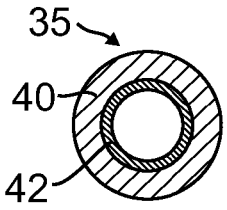
Figure 10C:
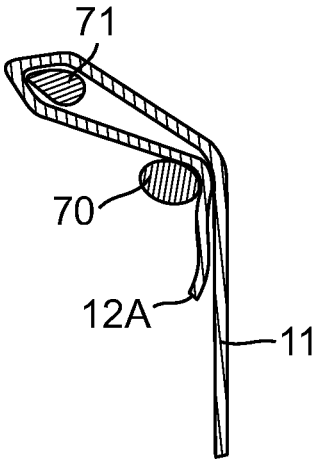
Figure 10D:
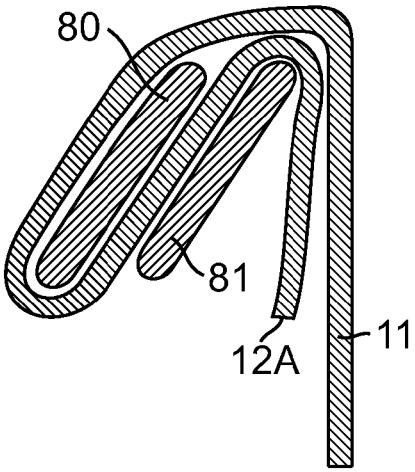

Although the configuration appears different, the base structure functions essentially the same as the preferred embodiment of the present invention. Members 63 and 64 extend lengthwise across the base structure in a direction parallel to handhold 35. When member 64 is fastened in place, opening 59 is formed between members 63 and 64. The opening has an entrance, located near edge 61, and an exit, located near edge 62, through which a band may pass. The band is secured to the handle in the same manner, namely through friction and turning in the band. The same general features are also true for the configurations depicted in FIGS. 10C and 10D, wherein members 70 and 71, as well as members 80 and 81, have different shapes and configurations, but serve the same basic function. Rather than a slot with a significant depth dimension, the opening through which the band passes could be a gap between two narrow members, such as rods.

One of the main functional differences between the various embodiments is the turning of the band. As can be appreciated from the drawing figures, the opening or slot can be oriented at various angles relative to the base structure, in order to alter the path of the band and the amount of turning. As discussed previously, as the amount of turning increases, the degree of securement increases. But this can also make it more tedious to adjust the length of the band, as the handle will need to be rotated more in order to switch it from the locked state to the unlocked state.

For embodiments in which the amount of turning is relatively less, a sturdy securement may still be achieved with certain compensations. For example, serrations or grooves could be utilized to grab the band and help retain it in place. Additionally, band 11 and base structure 13 can be manufactured to have a relatively sticky outer coating, which would lead to more friction being generated, so that less turning in the band would be required for securement. In contrast, to help facilitate the ease of adjustment, lubricant could be added to the band or handle. Also, members could have depressions or grooves on their surfaces to decrease the total surface area of member-to-band contact, thus decreasing friction and facilitating adjustment.

Overall, the present invention should not be construed to be limited to any particular number of degrees of turning in the exercise band. The turning in the band may exceed 360 degrees, as is the case in FIG. 10D, or be less than 360 degrees, as in FIG. 10C. Overall, the total amount of turning is roughly 360 degrees in the preferred embodiment, which is preferable to exceeding 370 degrees or more, which is preferable to 350 degrees or more, which is preferable to 340 degrees or more, which is preferable to 330 degrees or more, which is preferable to 300 degrees or more, which is preferable to 270 degrees or more, which is preferable to 240 degrees or more, which is preferable to 180 degrees or more.

Furthermore, more than two members may be employed—3, 4, 5, etc.—so that the band makes more total turns when secured. Rather than rotating the entire handle, the handle could be equipped with a means for rotating one or more of the members to allow for length adjustment. One or more members could have a locking mechanism, which would remain locked during exercise and be unlocked during length adjustment. The rotating means could comprise a lever that is pressed by the user to disengage the locking mechanism. For example, the lever could cause member 15 to tilt downward, allowing the band to slide.

FIGS. 12-25 pertain to a means for providing rotatable handholds in a way that is easy to manufacture and assemble. Rotatable handholds offer several advantages. For one, they allow for more versatile workouts, because many exercises are difficult to perform with handholds that are fixed, due to restricted hand movement. Moreover, rotatable handholds allow users to maintain neutral hand positions throughout an exercise movement, thereby minimizing wrist strain. Importantly, rotatable handholds serve to keep the axis of the handhold generally in line with the exercise band during use, which serves to maintain the securement of the band. In other words, as the handles pivot with respect to the user's arms during exercise movements, the handholds will rotate so that the exercise device maintains the configuration of FIG. 5. If the handholds did not rotate, this would cause the orientation of the band relative to the handles to change, which could result in the band slipping.

Figure 12:
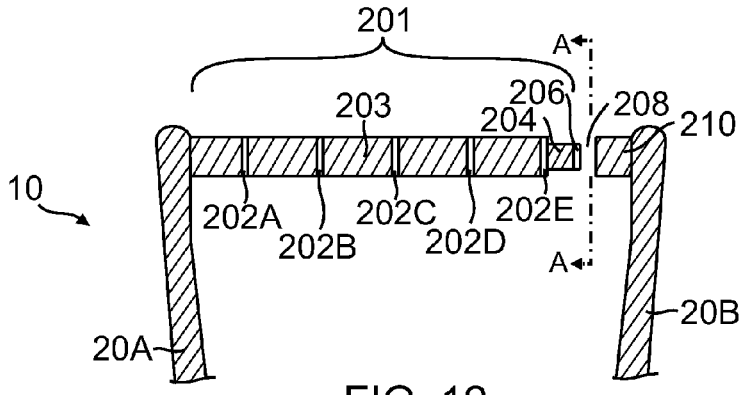
FIG. 12 shows a coronal cross-section of an unassembled handle, with arms 20A and 20B and connector 201.

FIG. 12 depicts unassembled handle 10 as it exists when first formed during the manufacturing process, such as after ejection from an injection molding press. Connector 201 projects medially from the distal end of arm 20A and is continuous with the arm such that the two may be molded together in the same piece. Segment 210 projects medially from the distal end of arm 20B and is also continuous with the arm. A small gap 208 exists between connector 201 and segment 210, allowing connector 201 and arm 20B to move independently. Connector 201 is made up of central spine 203, round discs 202A-202E which project outward from spine 203 in a perpendicular fashion, and one portion of a locking mechanism that is embodied in the free end of connector 201. The second portion of the locking mechanism is embodied in arm 20B, specifically within segment 210.

Figure 13:
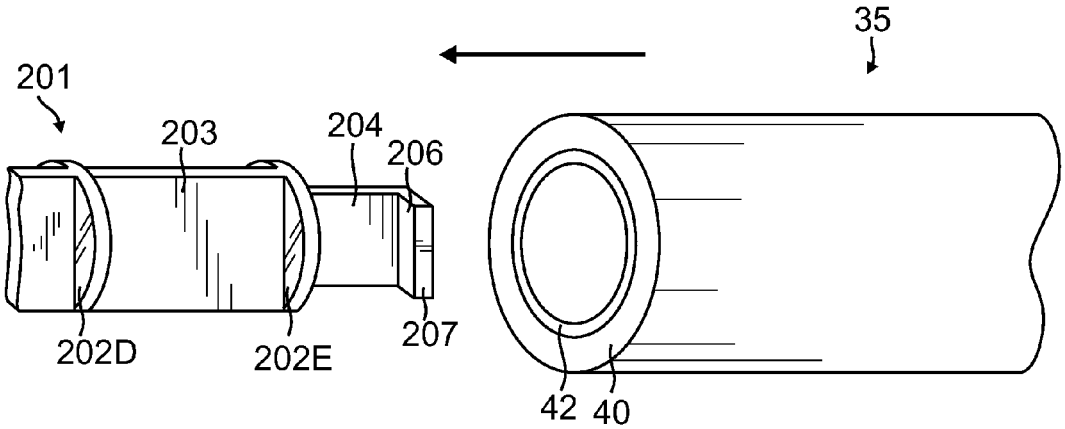
FIG. 13 is a close-up of connector 201 and handhold 35 during assembly.

Assembling the handle involves two basic steps, the first of which is illustrated in FIG. 13. Handhold 35, which includes rigid tube 42 and soft grip 40, is first emplaced upon connector 201. In order to make the free end of connector 201 accessible for this step, connector 201 and arm 20B are first shifted relative to one another, which can be accomplished by twisting arms 20A and 20B in opposite directions and/or bending connector 201. Once sufficient shifting has taken place, the free end of connector 201 is inserted into tube 42 and the handhold is then passed over the connector until it is fully inserted.

Figure 14:
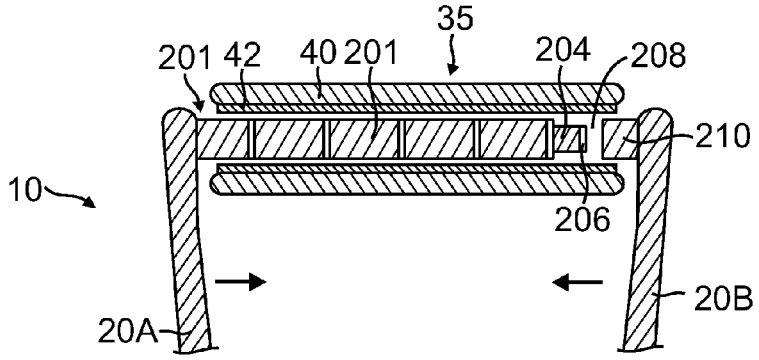
FIG. 14 shows a coronal cross-section of a partially assembled handle, just before connector 201 is fastened to arm 20B.
Figure 15:
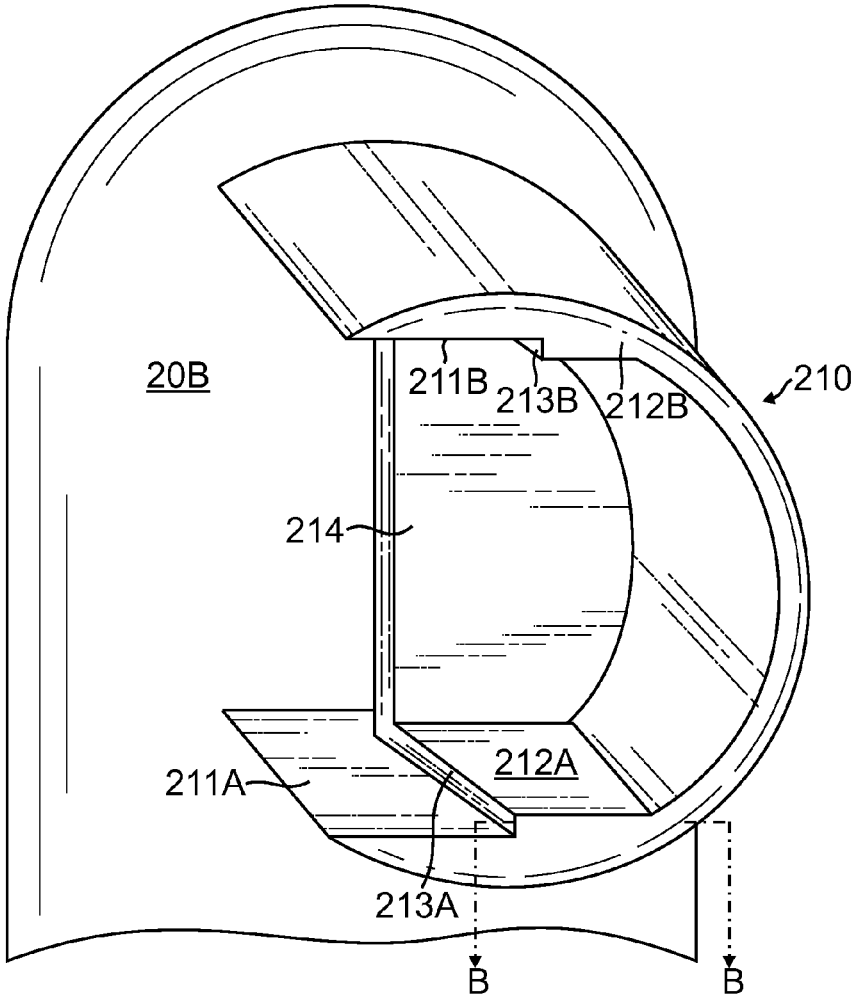
FIG. 15 is a perspective view of segment 210, taken from A-A of FIG. 12, looking toward arm 20B.

Next, arms 20A and 20B are brought closer together, which engages a locking mechanism that is best shown in FIGS. 13-17. FIG. 13 depicts the free end of connector 201 which includes projection 204 with outcropping 206 jutting out from the projection to form an L-shape. Contact surface 207 is located at the tip of outcropping 206. FIG. 14 depicts a coronal cross-section of the handle as the arms are first brought together, with segment 210 inserted into tube 42. FIG. 15, which is a view taken from A-A of FIG. 12 looking toward arm 20B, reveals that segment 210 has a generally cylindrically shaped outer surface with an opening at one end, interior surfaces 211A and 211B, side walls 212A and 212B, and retaining wall 214. Walls 212A and 212B have contact surfaces 213A and 213B which slope upwards as they approach retaining wall 214.

Figure 16:
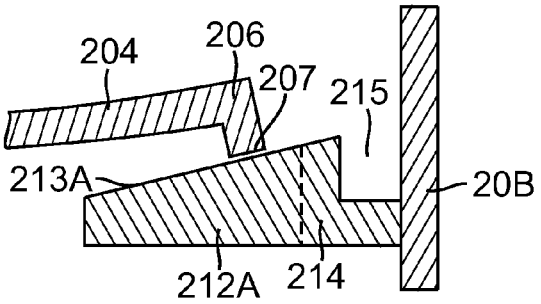
FIGS. 16 and 17 show horizontal sections taken through B-B of FIG. 15 and depict how the locking mechanism of the preferred embodiment engages.
Figure 17:
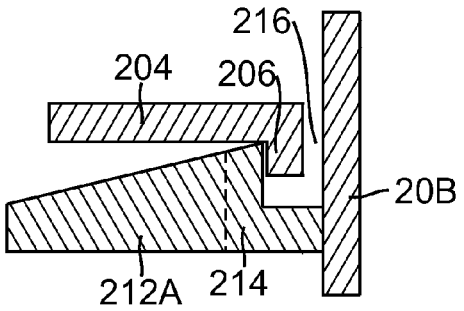
Figure 18:
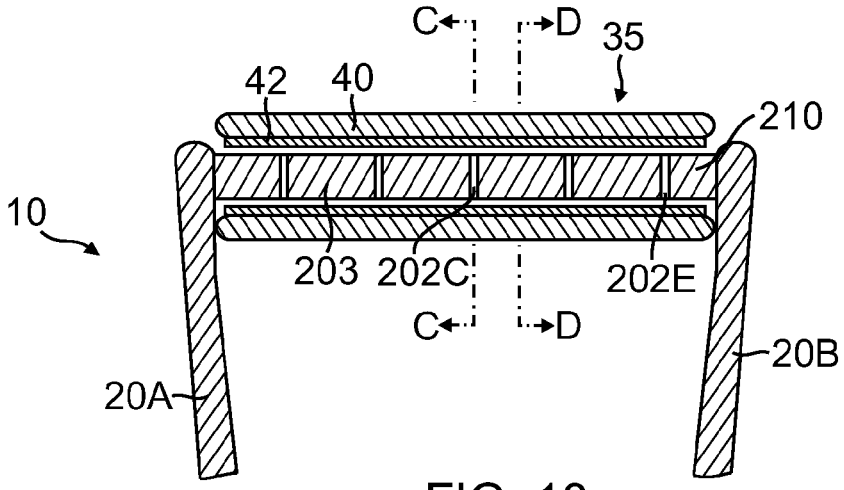
FIG. 18 is a coronal cross-section of an assembled handle.

Turning now to FIGS. 16 and 17 which show horizontal cross-sections through B-B of FIG. 15, as arms 20A and 20B are brought closer together, contact surface 207 will engage with contact surfaces 213A and 213B. As the arms are brought even closer together, projection 204 will bend as the contact surfaces slide past each other. Once the arms have been brought together sufficiently, outcropping 206 will clear retaining wall 214 and snap into place, occupying trough 215. Projection 204 fits snugly between surfaces 211A and 211B, which restricts connector 201 from moving up and down relative to segment 210. This helps prevent the locking mechanism from inadvertently disengaging. A coronal cross-section of an assembled handle with handhold 35 secured is shown in FIG. 18.

An advantage of the securing mechanism described herein is that the handle may be assembled in seconds, by merely emplacing the handhold and pressing the arms together. In the preferred embodiment, the base structure, arms, segment, and connector are all made of a strong but bendable plastic, to facilitate the assembly process. The design allows them all to be molded in one piece, for easy and inexpensive manufacturing.

Figure 19:
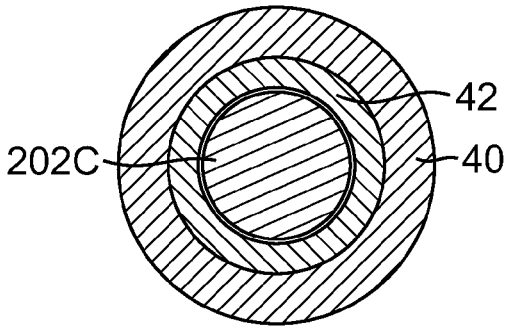
FIG. 19 is a cross-section through C-C of FIG. 18, illustrating how discs 202A-202E facilitate the rotation of the handhold.

During use, connector 201 and segment 210 are in contact with the inner surface of tube 42 and provide structure upon which the tube may rotate. Specifically, round discs 202A-202E and segment 210 have a diameter that is slightly smaller than the inside diameter of tube 42, which facilitates smooth rotation. This is illustrated by FIG. 19, a cross-section through C-C of FIG. 18.

Figure 20:
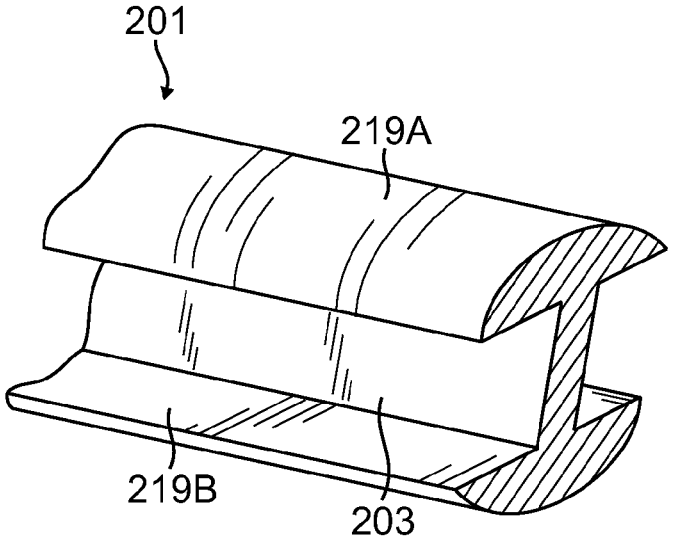
FIG. 20 shows an embodiment of connector 201 having flanges 219A and 219B.
Figure 21:
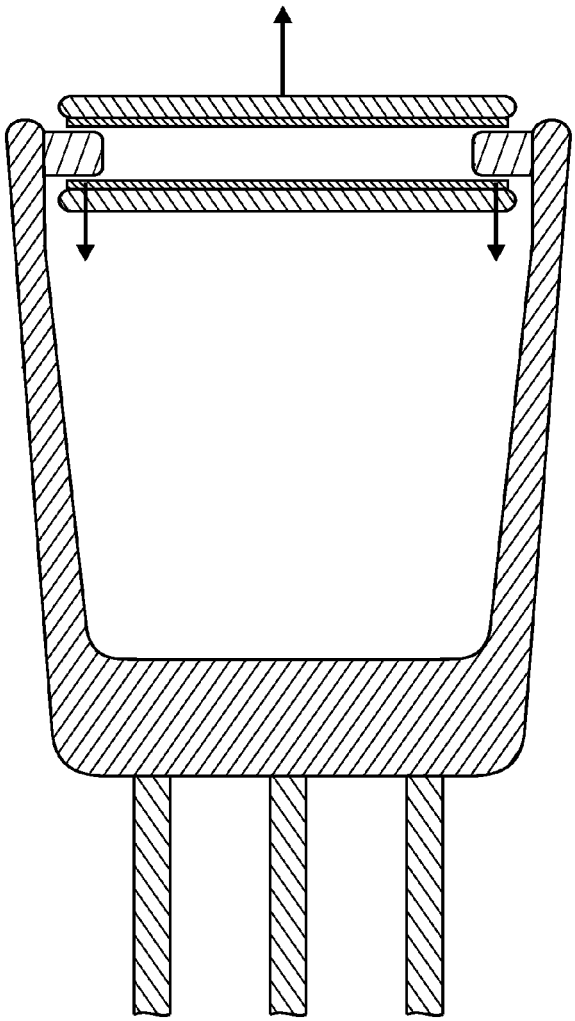
FIG. 21 (PRIOR ART)
FIG. 21 shows a prior art example of an exercise handle attached to three resistance tubes, and the primary forces exerted on the handle during use.

Instead of discs 202A-202E, one or more flanges could be present, as depicted in FIG. 20. Two generally horizontal flanges 219A and 219B project outward from the top and bottom of spine 203. The flanges run lengthwise along the connector and have rounded top and bottom surfaces designed for flush contact with the interior of tube 42. For increased strength, flanges and discs could both be present in connector 201.

A beneficial property of connector 201 and segment 210 is that they provide continuous rigid support to handhold 35 all along its length. This is a significant improvement over prior art examples involving pegs inserted into the ends of a handhold. For instance, when an exerciser pulls the handhold shown in FIG. 21, forces are applied to the ends and center of the handhold which are in opposition to each other. These forces can cause the central portion of the handhold to bend away from the base structure and may even cause the handhold to warp over time. The same issue applies to handholds that have flexible straps passing through them.

Figure 22:
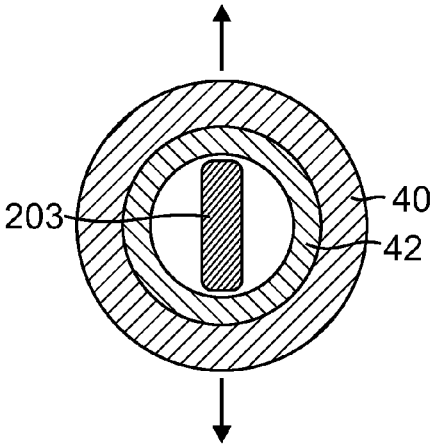
FIG. 22 is a cross-section through D-D of FIG. 18 revealing that central spine 203 is vertically oriented and aligned with the primary forces exerted on the handle during use.

With the present invention, a continuous link is formed between the two arms such that the connector and arms function as one solitary unit. This serves to distribute the forces more evenly throughout the handhold so that bending is less of an issue. Of note, central spine 203, which runs lengthwise throughout connector 201, is vertically oriented. In other words, spine 203 is aligned with the coronal plane of the handle, which puts it in line with the direction of the primary forces exerted on the handhold as illustrated in FIG. 22, a cross-section through D-D of FIG. 18. This orientation allows connector 201 to resist the handhold from bending during use. Furthermore, spine 203, which is generally flat and rectangular, is disposed centrally within tube 42 which allows the spine to have the maximum possible height and still fit within the tube. This allows the spine to be stronger and better resist the tube from bending.

This is especially beneficial during exercise movements in which the handles pivot with respect to the arms of the exerciser. For example, during a chest expansion exercise, the angle between the handles and the exerciser's arms will change from roughly 90 degrees with the arms straight ahead to close to zero degrees with the arms out to the sides. As handle 10 pivots during these sorts of exercises, the handhold will naturally rotate with respect to the rest of the handle, so that spine 203 will continue to remain in line with the direction of the primary forces, which allows connector 201 to resist the handhold from bending under a variety of exercise conditions.

A noteworthy feature of connector 201 is that it has a narrow wall thickness, which allows for faster and less expensive molding. In addition, because the connector helps prevent the handhold from bending, tube 42 can have a narrow wall thickness and still feel sturdy. This is a significant benefit because molding hollow tubes presents a manufacturing challenge related to the amount of time it takes to cool down the raw material. Hollow tubes take an especially long time to cool down, and having a narrow wall thickness can speed up production times and eliminate a potential bottleneck. In addition, because tube 42 is a simple cylinder with no extraneous features, this allows the tube to be extruded, if desired.

Figure 23:
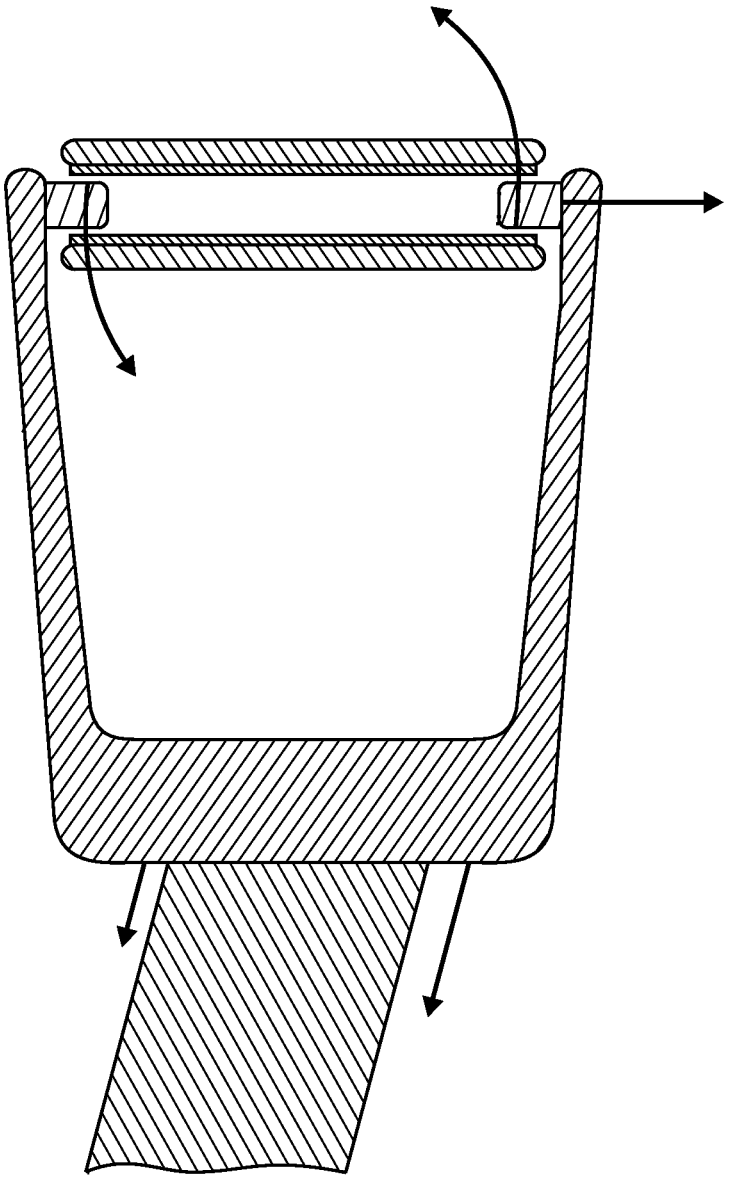
FIG. 23 (PRIOR ART)
FIG. 23 shows a prior art example of an exercise handle that has been laterally rotated, which causes unbalanced forces to be exerted on the handle.

FIG. 23 touches upon another issue pertaining to exercise handles which employ pegs inserted into the ends of a handhold. Some exercises involve movements in which the hands and wrists rotate laterally in such a way that the central axis of the handle is pulled out of alignment with the axis of any bands or tubes that are attached to it. This causes differing amounts of pull to be exerted on the base structure as illustrated by the long and short arrows of FIG. 23. This also causes the handhold to impart a rotational force on the pegs, while at the same time pressing laterally against one of the arms. Together, these unbalanced forces can act to separate the handhold from the pegs, which may cause the handle to recoil forcefully.

The securing mechanism discussed herein solves this problem by creating a continuous bridge between arms 20A and 20B, which locks the arms in place. When the arms are urged away from each other, as might happen when the unbalanced forces of FIG. 23 are imparted on the handle, wall 214 retains outcropping 206 in place, as can be appreciated from FIG. 17. Importantly, once the locking mechanism engages, the connection is a permanent one. The inner diameter of tube 42 is only slightly greater than the outer diameters of discs 202A-202E and segment 210. As a result, handhold 35 is restricted from shifting back and forth significantly. In turn, the handhold helps retain connector 201 and segment 210 in place to prevent them from shifting relative to each other. This makes it impossible for projection 204 and outcropping 206 to inadvertently shift and become disengaged. The only way for the locking mechanism to fail is for one or more of the components to fracture.

Figure 24A:
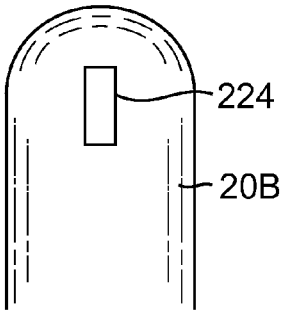
FIGS. 24A and 24B are side views of arm 20B showing an alternate locking mechanism.
Figure 24B:
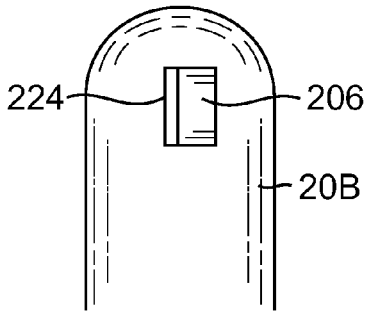

Of course, there are many other types of locking mechanisms which may be employed to attach connector 201 to arm 20B. For example, FIGS. 24A-24B are side views of the lateral face of arm 20B depicting a locking mechanism in which segment 210 is not part of the handle. FIG. 24A reveals hole 224 in the distal end of arm 20B. When arms 20A and 20B are brought closer together during assembly, outcropping 206 passes completely through hole 224, then snaps into place in the same manner described previously to adopt the configuration of FIG. 24B.

Figure 25A:
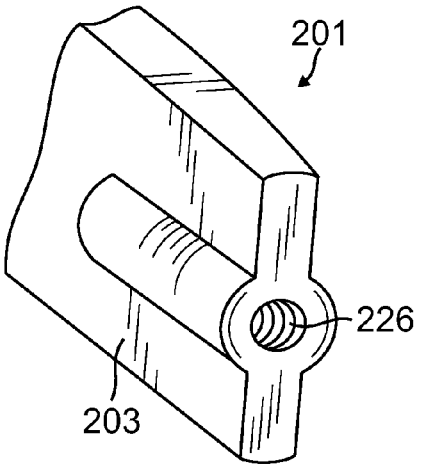
FIGS. 25A and 25B show a screw inserted through 20B and into connector 201, an embodiment that has a number of advantages.
Figure 25A:
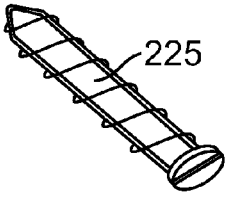
Figure 25B:
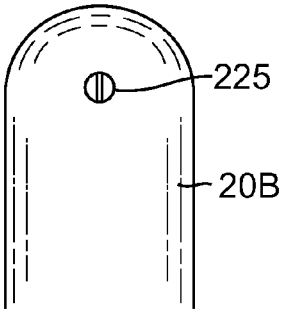

FIGS. 25A and 25B show another locking mechanism with considerable merit. Screw 225 passes through arm 20B and is inserted into well 226 which contains mating threads. FIG. 25B shows a side view of arm 20B with screw 225 inserted. A significant benefit of this embodiment is that it is fairly easy to design. Note that connector 201 is configured exactly the same as in FIGS. 12 and 13 except that well 226 replaces projection 204 and outcropping 206.

In addition, connector 201 could be glued, welded, or attached to arm 20B in various other ways, and this invention should not be construed to be limited by the specific fastening means discussed herein. Although the locking mechanism embodiments discussed thus far have certain variations, they share a number of commonalities. In each instance, one portion of the locking mechanism is embodied in connector 201, while the mating portion is embodied in arm 20B. In particular, segment 210, hole 224, and screw 225 are all considered to be mating structures embodied in arm 20B It should be pointed out that although the connector of the present invention is depicted along with an exercise band, it could also be utilized in handles that secure tubes, cables, springs, or the like. In general, the illustrations and descriptions herein of the exercise handles and other components of the present invention are for illustrative purposes only, and do not limit the present invention to any specific configuration or orientation. Having described preferred embodiments of a new and improved exercise handle, it is believed that other modifications, variations and changes will be suggested to those skilled in the art in view of the teachings set forth herein. It is therefore to be understood that all such variations, modifications and changes are believed to fall within the scope of the invention as defined by the appended claims.

What is claimed is:

1. An exercise device comprising an exercise band and an exercise handle, the exercise handle comprising:

a handhold configured to be held in a palm and fingers of a user during exercise;

a base structure configured to secure the exercise band; and two rigid arms attached to and extending from the base structure, the two rigid arms configured to retain the handhold;

the base structure further comprising:

a plurality of members; and an opening between the plurality of members, the opening having an entrance and an exit through which the exercise band is passed;

wherein the base structure engages the exercise band in a predetermined manner in which the exercise band is turned at least once around each member of the plurality of members, whereby the exercise band is partially wrapped clockwise around at least one member of the plurality of members and partially wrapped counterclockwise around at least one other member of the plurality of members; wherein a total amount of turning in the exercise band around the plurality of members exceeds 180 degrees, and the total amount of turning in the exercise band may be selectively altered between a first amount of turning, and a second amount of turning that is less than the first amount of turning: wherein the exercise handle may be selectively oriented in a first position relative to a section of the exercise band under tension during exercise, the first position corresponding to a locked state of the exercise device characterized by the first amount of turning, whereby the first amount of turning combined with the predetermined manner secures the exercise band to the exercise handle to prevent the exercise band from slipping relative to the exercise handle when the handhold is urged away from the exercise band;

wherein the exercise handle may be selectively oriented in a second position relative to the section of the exercise band under tension during exercise, the second position being different from the first position and corresponding to an unlocked state of the exercise device characterized by the second amount of turning, whereby the exercise band is permitted to slide relative to the base structure to enable the user to quickly and easily adjust an effectual length of the exercise band or interchange the exercise band with another exercise band; wherein the exercise device may be switched back and forth between the locked and unlocked states by respectively alternating the exercise handle between the first and second positions; wherein securement of the exercise band is capable of being achieved solely through the locked state of the exercise device, and wherein the plurality of members are fixed in position relative to each other.

2. The exercise device of claim 1, wherein a sagittal cross section of said plurality of members taken anywhere along their length reveals that each of the plurality of members has a perimeter that is surrounded by atmosphere, and said opening and said plurality of members each extend lengthwise across said base structure in a direction that is generally parallel to said handhold, said opening being elongated with a longitudinal length that is greater than a height of said opening and a width of said opening.

3. The exercise device of claim 2, wherein said opening comprises a narrow slot, with said entrance and exit located on different sides of said base structure.

4. The exercise device of claim 1, wherein the at least one of the plurality of members is embodied in the base structure in a fixed, permanent position, and another member is selectively fastenable to the base structure such that the another member is capable of being unfastened and then re-fastened in place to the base structure.

5. The exercise device of claim 1, wherein a first portion of the exercise band contacts a second portion of the exercise band such that the first portion presses the second portion firmly against said base structure when the exercise device is in use, such that friction is established between the first and second portions of the exercise band, thereby helping to prevent the exercise band from slipping during exercise.

6. The exercise device of claim 1, wherein the securement of the exercise band is achieved without the use of a securing mechanism of the exercise handle that must be moved or shifted independently relative to any part of the exercise handle in order to secure the exercise band.

7. The exercise device of claim 1, wherein said base structure and said two rigid arms are unitary, capable of being molded together simultaneously in one piece using a same raw material.

8. The exercise device of claim 1, wherein said handhold has a rigid tube with a hollow interior and said exercise handle further comprises a rigid connector disposed between distal ends of said two rigid arms in a fixed manner and inserted through the hollow interior of the handhold, whereby the handhold is permitted to rotate with respect to the base structure during exercise.

9. The exercise handle of claim 1, wherein said total amount of turning exceeds 270 degrees.

10. The exercise handle of claim 1, wherein said total amount of turning is approximately 360 degrees.

11. The exercise device of claim 1, wherein the exercise handle may be selectively oriented in the first position by rotating the exercise handle in a first direction to select the first amount of turning, and wherein the exercise handle may be selectively oriented in the second position by rotating the exercise handle in a second direction opposite the first direction to select the second amount of turning.

12. The exercise device of claim 1, further comprising a fastening means for holding the exercise band in fixed relation to the exercise handle, thereby ensuring the exercise band will not slip during use.

13. The exercise device of claim 12, wherein the fastening means comprises a wedge and wherein the base structure further comprises a cavity, the wedge being configured to be pressed against the exercise band and inserted into the cavity such that the exercise band is pinned between the wedge and walls of the cavity, thereby causing pressure to be exerted between the wedge, the exercise band, and the walls of the cavity, thus fastening the exercise band to the base structure.

14. A method of securing an exercise band to an exercise handle comprising the steps of:

(a) providing the exercise handle, the exercise handle comprising: a base structure having a plurality of members, and at least one opening between the plurality of members; and two rigid arms extending from the base structure, the two rigid arms configured to retain a handhold wherein the base structure and the two rigid arms are unitary, capable of being molded together in one piece;

(b) inserting the exercise band through the at least one opening;

(c) engaging the exercise band with the base structure in a predetermined manner, in which the exercise band is turned at least once around each member of the plurality of members, with the total amount of turning in the band exceeding 180 degrees;

(d) pulling the exercise band through the at least one opening, until a desired location on the exercise band is aligned with the base structure; and (e) releasing the exercise band, whereby the total amount of turning combined with the predetermined manner secures the exercise band to the exercise handle to prevent the exercise band from slipping relative to the exercise handle when the handhold is urged away from the exercise band.

15. The method of claim 14, wherein securement of the exercise band is capable of being achieved without employing a securing mechanism of the exercise handle that is moved independently of the exercise handle in order to secure the exercise band, the securing mechanism being selected from: latches, clips, hooks, clamps, impingers, and cinchable loops.

16. The method of claim 14, wherein securement of the exercise band is capable of being achieved solely by steps (a) through (e), and wherein the plurality of members are fixed in position relative to each other.

17. The method of claim 14, wherein said exercise band has a sequence of markings corresponding to different levels of resistance, and said method further comprises the step of:

(f) selecting a particular marking of the sequence of markings and positioning the exercise band so that the particular marking is in a particular location relative to the exercise handle.

18. The method of claim 14, further comprising the steps of:

(f) taking a second exercise handle having a means for fastening the exercise band; and (g) fastening the exercise band to the second exercise handle such that the exercise band will not slip in relation to the second exercise handle during exercise, thus enabling a user to establish and maintain a desired level of resistance.

19. The method of claim 14, further comprising the steps of:

(f) rotating said exercise handle in a first direction that causes said total amount of turning to be decreased;

(g) sliding the exercise band through said at least one opening; and (h) rotating said exercise handle in a second direction opposite the first direction to increase the total amount of turning and re-secure the exercise band, thereby allowing an effectual length of the exercise band to be adjusted.

20. The method of claim 19, wherein steps (f), (g), and (h) take place during an exercise set while the exercise hand is under tension and thereby configured to pull the exercise band through said at least one opening, whereby a user may increase the effectual length of the exercise band without releasing a grip of the user on the handhold or without the user having to physically touch the exercise band.

21. The method of claim 14, further comprising the step of:

(f) manually pulling said exercise band at an angle relative to an orientation of the exercise band during exercise, said angle being such that the total amount of turning in the exercise band is reduced by an amount capable of allowing the exercise band to freely pass through said at least one opening, thus permitting an effectual length of the exercise hand to be shortened or lengthened.

22. The method of claim 14, wherein a configuration of said base structure allows the exercise band to gradually slip past said exercise handle between repetitions of an exercise set, such that a resistance level may be decreased during the exercise set, allowing a user to perform additional repetitions before reaching muscular exhaustion.

* * * * *